United States Patent [19]

Bentley

[11] Patent Number: 4,968,364

[45] Date of Patent: Nov. 6, 1990

[54] CONDUCTING PRIMER COMPOSITIONS

[75] Inventor: John R. Bentley, Ascot Vale, Australia

[73] Assignee: The Commonwealth of Australia, Canberra, Australia

[21] Appl. No.: 446,542

[22] Filed: Dec. 5, 1989

[30] Foreign Application Priority Data

Dec. 5, 1988 [AU] Australia ..... PJ1757

[51] Int. Cl.[5] ..... C06B 41/02

[52] U.S. Cl. ..... 149/24; 102/202.5; 102/200

[58] Field of Search ..... 149/24; 102/200, 202.5

[56] References Cited

U.S. PATENT DOCUMENTS

| | | | |
|---|---|---|---|
| 3,320,104 | 5/1967 | Stadler et al. | 149/24 |
| 3,321,343 | 5/1967 | Staba | 149/24 |
| 3,983,149 | 9/1976 | Kenney | 149/24 |
| 4,029,530 | 6/1977 | Kenney | 149/24 |
| 4,247,494 | 1/1981 | Carter | 149/24 |
| 4,336,084 | 6/1982 | Urs | 149/24 |
| 4,605,453 | 8/1986 | Spear et al. | 149/24 |

*Primary Examiner*—Stephen J. Lechert, Jr.

*Attorney, Agent, or Firm*—Roylance, Abrams, Berdo & Goodman

[57] ABSTRACT

A conducting composition for detonators having insensitivity to one amp of current or one watt of power comprising 40 to 80 parts by weight of lead styphnate 2 to 10 parts by weight of carbon black or graphite and the balance being lead oxide. Firing times of less than eight milliseconds can be achieved where at least one percent of graphite is included in the composition.

4 Claims, No Drawings

CONDUCTING PRIMER COMPOSITIONS

This invention relates to conducting compositions for use in primers and for use in detonators.

Generally electrically activated explosives use bridge wire devices for actuation. Such devices are relatively are expensive and difficult to produce.

The present invention is particularly concerned with applications where power insensitivity is particularly important.

U.S. Pat. No. 4,605,453 discloses a conducting composition for use in a firing cap which has high energy insensitivity. The power sensitivity however is particularly low. Devices containing these compositions can be initiated with power of less than one watt. It is important in designing primers and detonators that they comply with a requirement of being insensitive to both one amp or one watt.

It is an object of the present invention to provide a conducting composition which complies with these requirements.

To this end the present invention provides a conducting composition suitable for use in a detonator consisting of 2 to 10 parts by weight of carbon black and or graphite 40 to 80 parts by weight of lead styphnate the balance being lead oxide or other explosive or non-explosive material said composition being formulated to ensure insensitivity to one amp of current or one watt of power.

It is preferred that the conducting composition utilise normal lead styphnate which has a mean particle size not less than 5 microns in admixture with carbon black or graphite which has a mean aggregate size between 0.5 microns and 15 microns.

However, a failing of the compositions taught in the U.S. Patent is that they do not have good power or current insensitivity.

It is a preferred requirement of one aspect of the present invention that the content of carbon black is adjusted to provide resistance within the range of half to three ohms. This requirement compares with resistance levels ranging upwards from 16 ohms in US Patent 4,605,453.

In preparing compositions according to this aspect of the present invention, the voltage and current sensitivities are approximately the same and this can be achieved by preferably adjusting the composition to have a nominal resistance of approximately 1 ohm.

However, where resistance is lower the speed or firing time of devices containing the composition is relatively slow. Generally for resistances of 0.8 to 1.2 ohms and a firing current of 5 amps times of greater than 50 milliseconds are expected.

In another preferred aspect of this invention compositions of firing times less than 50 milliseconds and preferably less than 8 milliseconds for a firing current of 5 amps are provided which still satisfy the one amp, one watt insensitivity requirement. This is achieved by using graphite which has a higher conductivity than carbon black and adjusting the final resistance to 1.3 -3 ohms. The graphite can replace all or some of the carbon black depending on the desired functioning time. Preferably at least one percent by weight of graphite is used.

It is to be noted that the firing time decrease is achieved with an increase in resistance and thus the current insensitivity may approach the threshhold of one amp if the resistance is too high.

The following are particular examples of preferred formulations of this invention.

EXAMPLE 1

One preferred formulation of the present invention comprises a conducting composition having the following composition:

| | |
|---|---|
| Carbon black (Tintacarb) | 7.5% by weight |
| Lead Oxide | 30.0% by weight |
| Lead Styphnate | 62.5% by weight |

The energy and power sensitivity was determined from Breucton tests. Results were as follows:

| | |
|---|---|
| ENERGY | Capacitance 2.95 μF |
| | Increment 0.05 (log units) |
| | Number Tester 25 |
| | Mean 3.764 (5808 μJ) |
| | S.Dev 0.041 (log units) |
| | Energy Threshold 3.98 mJ |
| POWER | Constant Current Supply |
| | Increment 0.1 A |
| | Number Tested 25 |
| | Mean 2.3 A |
| | S.Dev 0.18 A |
| | Threshold Current 1.58 A |
| | Threshold Power = $I^2R$ min = 2.5 W |

EXAMPLE 2

| | |
|---|---|
| Carbon Black (Tintacarb) | 2% by weight |
| Graphite | 2% by weight |
| Lead Styphnate | 66% by weight |
| Lead Oxide | 34% by weight |

THis composition had a firing time of less than 8 milliseconds and was insensitive to one amp of current and one watt of power.

EXAMPLE 3

| | |
|---|---|
| Carbon Black | 3.5% by weight |
| Graphite | 1% by weight |
| Lead Styphnate | 64.5% by weight |
| Lead Oxide | 30% by weight |

This composition had a firing time of less than 8 milliseconds and was insensitive to one amp of current and one watt of power.

The compositions of the present invention are useful in any situation where bridge wire devices are required to be replaced by a cheaper yet power insensitive device. A typical application is in relation to automobile crash bags where an electrically activated explosive charge is required to initiate inflation of the protective bag and this risk of unintended initiation must be low.

These conducting compositions can be used wherever electrically initiated detonators or igniters are used and can be formulated for a wide range of firing times and still be insensitive to one amp of current or one watt of power.

From the above description it can be seen that the present invention provides a new and useful conducting primer composition which overcomes difficulties associated with alternative initiating devices.

I claim:

1. A conducting composition suitable for use in a detonator, comprising:

2 to 10 parts by weight selected from the group consisting of carbon black, graphite and mixtures thereof; and 40 to 80 parts by weight of lead styphnate, the balance being lead oxide;

said composition being formulated to ensure insensitivity to one amp of current or one watt of power.

2. A composition as claimed in claim 1 wherein normal lead styphnate is used in conjunction with material selected from the group consisting of carbon black, graphite and mixtures thereof to produce devices with resistances of between a half and 3 ohms.

3. An electrically initiated detonator, primer or igniter incorporating a conducting composition as claimed in claim 1 or 2.

4. A detonator, primer or igniter as claimed in claim 3 in which the firing time is less than eight milliseconds and the composition incorporates at least one percent by weight of graphite.

* * * * *